US006050736A

United States Patent [19]

Gonzalez

[11] Patent Number: 6,050,736

[45] Date of Patent: Apr. 18, 2000

[54] TOOTHBRUSH WITH TOOTHPASTE PASSAGE OBTURACTION AND FEED SYSTEM

[76] Inventor: David Mejias Gonzalez, Urbanizacion El Paular, Bloque 48, Entreplanta B, E-28220 Majadahonda, Spain

[21] Appl. No.: 08/913,937

[22] PCT Filed: Jan. 17, 1996

[86] PCT No.: PCT/ES96/00008

§ 371 Date: May 27, 1998

§ 102(e) Date: May 27, 1998

[87] PCT Pub. No.: WO97/25901

PCT Pub. Date: Jul. 24, 1997

[51] Int. Cl.[7] ..... A46B 11/04

[52] U.S. Cl. ..... 401/281; 401/272; 401/273

[58] Field of Search ..... 401/281, 272, 401/273, 275, 151, 143, 153, 170

[56] References Cited

U.S. PATENT DOCUMENTS

| | | | |
|---|---|---|---|
| 3,261,367 | 7/1966 | Pickering | 401/153 |
| 3,400,996 | 9/1968 | Bandergrift | 401/143 |
| 3,937,235 | 2/1976 | Broughton | 401/272 |
| 5,154,523 | 10/1992 | Devreeze | 401/153 |

*Primary Examiner*—David J. Walczak

*Attorney, Agent, or Firm*—Helfgott & Karas, P.C.

[57] ABSTRACT

The toothbrush includes a handle and a head, the handle forming two bodies (1) and (2) provided with overlapping sectors (3), which permit the axial displacement, one with respect to the other, the body (1) constituting a container (4) for the toothpaste, which can be projected toward the exit (14) through a duct (7-8), in which are defined two sectors, one rigid (7) and the other flexible (8), the latter of the bellows type, sector (7) ending in a one-way valve (12-13), which tends permanently toward the closed position and which, while permitting the passage of the toothpaste toward the exit (14), blocks the return of the toothpaste in the backward direction axially of the body (1). An embolus (15) fills up the inside of the body (1), compensating for the dose of toothpaste which is supplied, while in the exit (14) a manually operated valve (17) is incorporated in the cylinder provided in an diametral orifice (18), which can be made to align with or not align with the exit orifice (14). The head (26) of the toothbrush is coupled to a tubular core (27), in which the extreme anterior of the body (2) of the handle ends, which head (26) being capable of movement with relation to the tubular core (27) in such a way that, when it is displaced outward, between a gasket (29) and the mouth (30) of the tubular core (27), a chamber (31) is defined, which communicates with the outside through an exit orifice (32), which orifice closes behind the dose of toothpaste by means of a new axial retraction of the head (26) on the tubular core.

11 Claims, 4 Drawing Sheets

TOOTHBRUSH WITH TOOTHPASTE PASSAGE OBTURACTION AND FEED SYSTEM

DESCRIPTION

OBJECT OF THE INVENTION

This invention relates to a toothbrush of the type, which incorporates a compartment in its handle for toothpaste, the purpose of the invention is centered on the feed system for toothpaste, each time it is necessary or required by the user, as well as the system of blocking the compartment containing said toothpaste.

It is also the object of the invention to supply the head with means, which make it possible to close the toothpaste passage toward the corresponding bristles, in order to prevent the accumulation and drying out of the toothpaste in its exit duct toward the bristles.

BACKGROUND OF THE INVENTION

In the area of oral hygiene, toothbrushes are known which, as stated above, have a hollow handle, which determines a container for toothpaste, capable of supplying the latter to the bristles of the head, for example, by means of simple elastic deformation of said handle, as occurs in Spanish Patent numbers 8701529 and 9000983, in Patent Application PCT W 091/13569, in the European Patent Application 0 407 917 and in the Spanish Utility Models 8902663, 8700520 and 8800095, while other solutions, such as, for example, Spanish Patent 900083 or Utility Model 8700838, provide pushing means to pump the toothpaste from the handle toward the head.

In each case, at least one orifice is disposed in the head of the toothbrush. This orifice is maintained permanently open for discharging toothpaste and results in problems of drying and deterioration of the product. At the same time, the manipulation of the toothbrush may involuntarily result in deformations of the handle which, in turn, causes an undesired exit of the toothpaste through the head.

One apparent solution to this problem is one, which is offered in PCT W 090/09122, in which a toothbrush is provided, the head of which rotates in such a manner that the toothbrush is kept isolated until the moment of initiating the use of the toothbrush, at which time the rotation of the head establishes communication between it and the reservoir of toothpaste detained in the handle. However, this solution is provided for single-use toothbrushes and, if applying the principle to multi-use toothbrushes was desired, it would then be effective only until the time use was initiated, since after communication is first established between the reservoir and the head, it cannot be reclosed.

DESCRIPTION OF THE INVENTION

The toothbrush, which is being suggested, includes a system to feed and to block passage of the toothpaste toward the head, therefore, a system of blockage in said head prevents, when the user so desires, toothpaste from coming toward the bristles of said head.

The feed system, which is a part of the purpose of the invention, is based on pushing, to pump the toothpaste from the handle to the head, and means for blocking, which permit or prevent the passage of said toothpaste toward the head.

More concretely, beginning with the hollow structuring of the handle of the toothbrush in order to form the corresponding compartment, which makes it possible to house the toothpaste in its interior, the inventive toothbrush has the characteristic that the handle itself is structured on the basis of two bodies coupled telescopically and hermetically sealed in a manner that axial retraction of one body with respect to the other results in a defined volumetric reduction on its interior, more concretely, one of these bodies, the one which acts as the actual container, being equipped with an axial orifice at its internal end, to which a duct is coupled for the exit of the toothpaste, which duct is axially solid with the other body and which, for the purpose of permitting the axial relative displacement between them, must have a section, which is structured to be springy, said duct abutting a one-way valve, which tends permanently to the closed position due to the effect of a spring, against which it is forced open by the pressure of the toothpaste when the two bodies, which constitute the handle, are retracted, with respect to one another.

In accordance with another of the characteristics of the invention, a dosing shell is solid with the first body, the one which constitutes the container, which shell is on the inside of the second body and which, as a result of its own length, will determine the maximum displacement of one body with respect to the other and, as a consequence, the dose of toothpaste to be supplied by the former upon each actuation.

In the interior of the container defined by the first body, there is disposed an embolus, preferably assisted by a spring, which minimizes the volume of the sector of said constituent body of the container itself, as the consumption of the toothpaste advances.

At the end of the toothbrush, near the head, beyond the one-way valve mentioned above, a manually operated valve is disposed consisting of a small cylinder equipped with a diametral orifice, which is capable of facing toward or away from the duct, which said cylinder interrupts, emerging, partly to the outside so that it can be acted upon directly, for example with the ball of one of the fingers of the hand.

Returning to the one-way valve mentioned above which, assisted by a spring, tends toward the closed position, it has been provided that this valve may optionally be replaced by another manually operated valve, in which case the exit for the toothpaste must be eccentric in the structure of the handle, and that in the location provided for closing, there is disposed, interrupting such duct, a disk, which is in turn provided with an eccentric orifice in such a manner that this orifice may or may not connect to the exit duct for the toothpaste, so as to obtain respectively the open and closed positions.

The possibility has also been provided that, for replacement of this blocking disk, the corresponding body incorporates two physically independent sectors, capable of rotating one with respect to the other, for the purpose of aligning or not aligning the two corresponding segments for the exit duct of the toothpaste, also corresponding respectively to the open and closed position of the valve.

The one-way valve may be supplemented with another located at the opposite end of the orifice, which connects the two bodies of the handle to each other, which one-way valve will make it possible for the embolus pushing the toothpaste not to be associated with a shell behind and inside, therefore making possible the advance but not return, that is, an anti-return.

In addition to the system or means of blockage referred to above and provided in the handle, the toothbrush may incorporate another blocking system provided in the head, for which the head is structured with a tubular core rigidly fastened to the handle, as an extension thereof, and in direct communication with the chamber defined on the interior of such handle, with the head itself attached to such tubular core, with the possibility of axial displacement between two limit positions, the limits being established by any appropriate means, such as, for example, a fin solid to the tubular core and which moves in an orifice cut from the head itself, with the special characteristic that between these two elements, the head and tubular core, a perfect adjustment is established creating a hermetic seal, that the tubular core is open at its free end toward the closed bottom of the head itself, that in such bottom there is disposed a joint capable of sealing hermetically the mouth of the tubular core, and that at the limit position of maximum distance from the head itself with respect to the handle, it is separated from the mouth of the tubular core, defining a small space corresponding to which the exit orifice for the toothpaste toward the bristles of the head is provided.

The exit orifice for the toothpaste toward the bristles of the head is milled out and, in it, the fin moves, functioning, as a limited stop for range, in addition to acting as a cleaning element for the toothpaste exit duct, thereby achieving that the toothpaste, which remains in the exit duct, does not dry out, for which purpose this duct and the lever operating on it are inclined in form so as to facilitate the expulsion of the toothpaste to the bristles, easily evacuating the residual paste, which remains in such duct.

Finally, and in accordance with another of the characteristics of the invention, it has been provided that the free end of the tubular core, in which the opening for the toothpaste is located, is provided with a small groove, and on it, a rounded edge, so that, with a supplementary configuration for the sealing joint, advantageously made solid with the end of the housing of the head, a "male-female" coupling between the two pieces is produced, which makes the closing or blocking position stable for said opening.

DESCRIPTION OF THE DRAWINGS

To supplement the description, which is being given and, for the purpose of assisting better comprehension of the characteristics of the invention, attached to this descriptive report as an integral part hereof is a set of drawings, in which the following has been represented, with an illustrative and not limitative nature.

PREFERRED EMBODIMENT OF THE INVENTION

Figure 1:
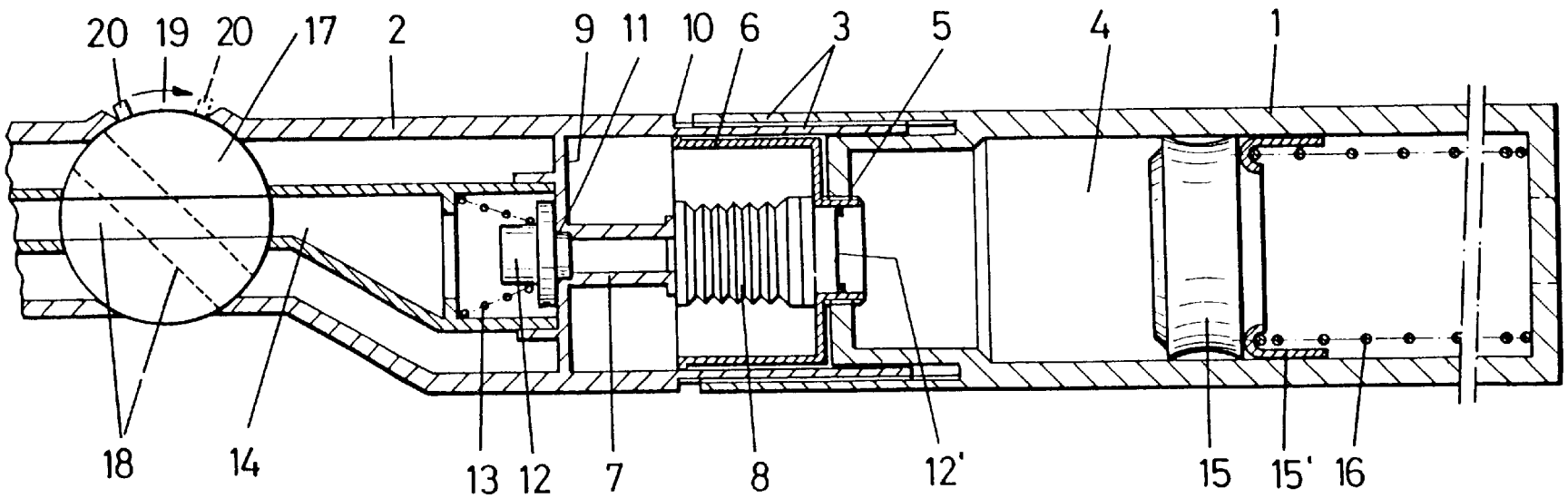
FIG. 1 shows a schematic representation in side view and longitudinal cross section of the handle of the brush in the invention, provided with the feed and blocking system for the toothpaste.

By examining these Figures, and most concretely FIG. 1, it can be observed how the inventive toothbrush includes a handle structured on the basis of two bodies (1) and (2), coupled together axially through overlapping sectors (3). The body (1) further from the bristle-bearing head, which is not represented, constitutes a compartment or container (4) for the toothpaste, which container is largely closed and provided with an axial orifice (5) at its anterior end. The orifice is coupled, by means of a shell/guide (6) moving in the interior of the body (2), to an axial duct, in which a fixed sector (7) and a sector (8), structured as a bellows, which makes possible the shortening/lengthening of the duct including elements (7) (8). The shell (6) also being capable of acting as a dosing device, as stated above, by means of an appropriate axial length thereof bounded by the transverse wall (9) of the body (2) or with the actual overlapping sectors (3) between the bodies (1) and (2) acting as a dosing means through the notching (10) and as is observed especially in FIG. 1.

The transverse wall (9) also constitutes, through the orifice (11), the seat for a blocking device (12) which, together with the spring (13), form a one-way valve which tends to close the duct (7) in such a manner. The duct (7) is closed that the second phase of the operation of activation of the system, that is, when the body (1) is moved away from the body (2), the product located at the exit (14) of the handle of the toothbrush cannot return to the container (4), nor to that disposed in the duct (7). The quantity of toothpaste supplied being compensated for by the advance of an embolus (15) which moves in the interior of the body (1), that is, in the container (4), and which in turn is assisted by a spring (16), appropriately calibrated so that when one presses axially on the body (1), said embolus (15) does not retract, but rather the opening of the one-way or anti-return valve (12) opens, so that the embolus (15) itself is supplemented with a posterior shell (15'), against which it is precisely the spring (16) which acts, which shell (15') has a configuration such that it can advance but not retract.

On the other hand, in addition to the one-way valve, formed by the blocking means (12) and the spring (13), a second one-way valve (12') is provided in the shell (6). Valve 21' is concretely connected in the neck of the coupling on the orifice (5) of the body (1), as is also shown in FIG. 1. The one-way valve does not permit the return of the toothpaste into the reservoir, if there is no retention shell (15') behind the embolus (15), which pushes the toothpaste.

Supplementary to the structure described, the exit (14) is interrupted by a rotary cylinder (17) provided with a diametric hole (18). The periphery cylinder (17) extends to the outside through a window (19) in the body (2) itself, in which a small fin (20) moves, solid to said cylinder, in such a manner that when said fin (20) occupies its end position in the window (19), as represented in a continuous line in FIG. 1, the axial orifice (18) is aligned with the exit (14). This manual valve is kept in the open position while when the fin (20) is moved to the position represented by the dashed line, as indicated in the arrow of FIG. 1. Cylinder (17) turns to the position also represented by the dashed line corresponding to the closed positions.

From this basic structure, it is feasible to eliminate the spring (16) which aids the embolus (15), establishing a coefficient of friction between said embolus and the lateral wall of the body (1) sufficient to achieve an effect similar to that of said spring.

There also exists the possibility of eliminating the deformable section (8) of the duct in such a manner that said sector is rigid, the same as the sector (7), in which case both sectors must be telescopically coupled.

Figure 2:
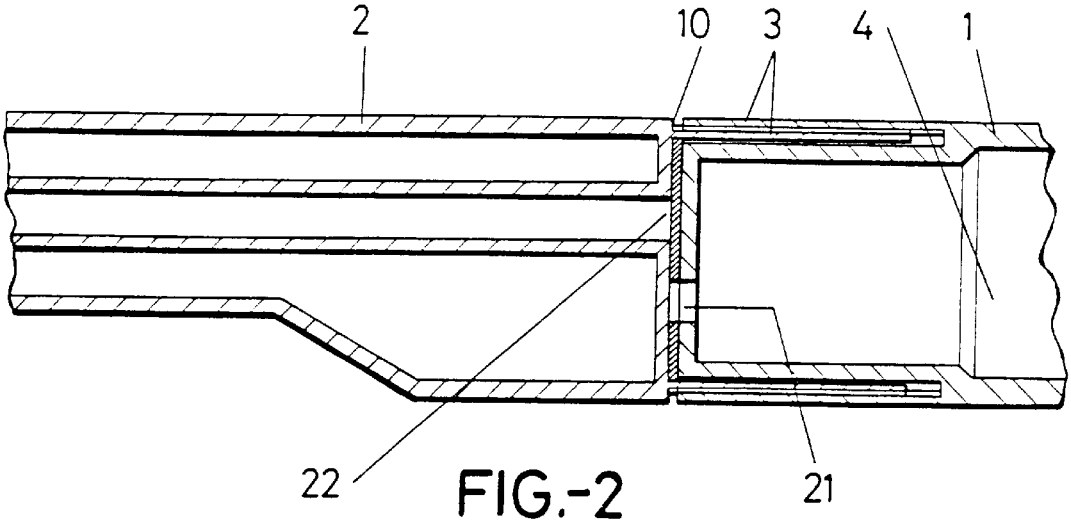
FIG. 2 shows a detail of the assembly represented in the previous Figure, according to an embodiment variant, in which the one-way check valve has been replaced by a manually operated valve, which operation is carried out by partially turning the two sectors of the body between which this valve is disposed.
Figure 3:
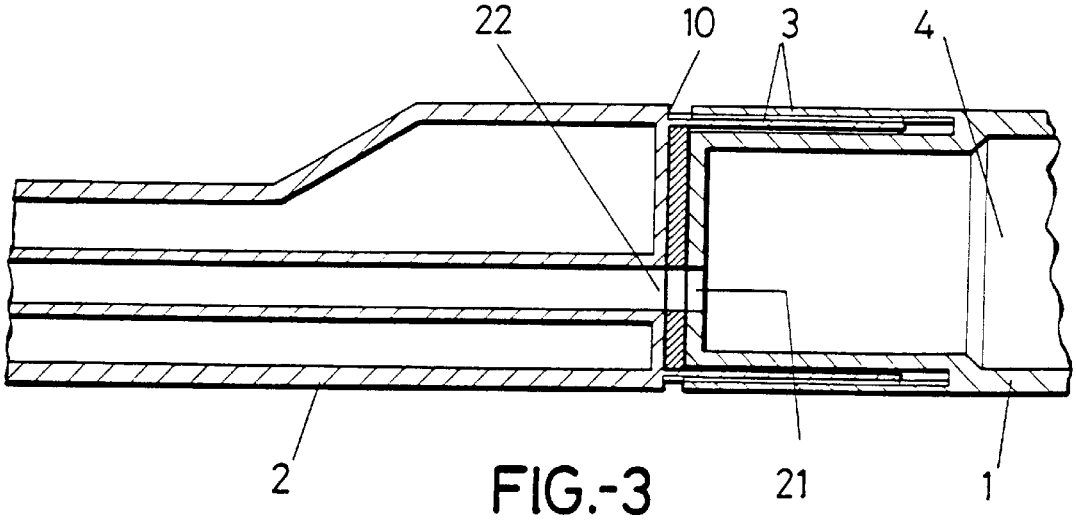
FIG. 3 shows the same detail as FIG. 2, in the open position.
Figure 5:
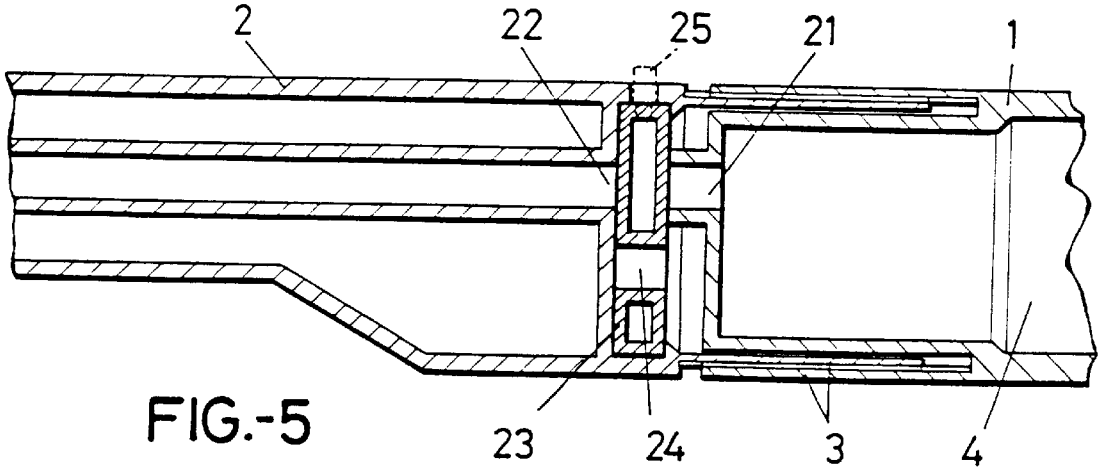

FIGS. 2 and 5 show an embodiment variant, in which the check valve, made up by the blocking device (12) and the spring (13), may be replaced by a manually operated valve by placing eccentric ducts (21) and (22) in the bodies (1) and (2), in which case bodies (1) and (2) must be capable of rotating relative to each other in such a manner, that the orifices (21) and (22) are not aligned, relative to the closed position represented in FIG. 2, or aligned, relative to the open position represented in FIG. 3.

Figure 4:
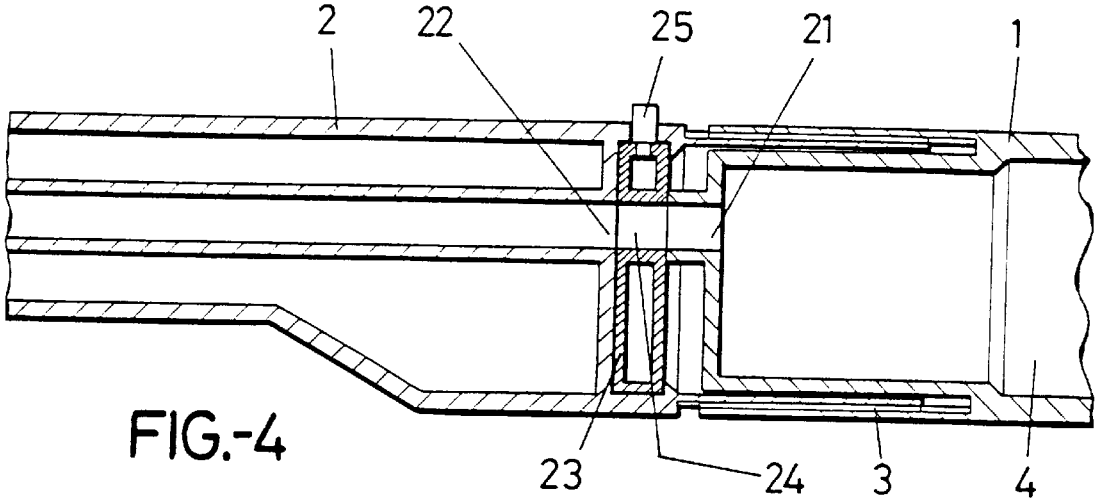
FIGS. 4 and 5 show interior details similar to those of FIGS. 2 and 3, corresponding to the other embodiment variant, in which the blocking/unblocking is achieved instead of by turning a sector of the body with respect to the other, by turning a blocking disk placed between them.

The possibility also exists, in accordance with the representation in FIGS. 4 and 5, of the bodies (1) and (2) not rotating with respect to the other and which, maintaining the same eccentric orifices (21) and (22), in this case permanently aligned, between them, there is placed a rotating disk (23), also provided with an eccentric orifice (24), with this disk (23) being provided with an actuator (25) which extends to the exterior and which allows it to adopt two positions, that position represented in FIG. 4, in which its orifice (24) is axially aligned with the orifices (21) and (22) corresponding to the vertical open position, and that position represented in FIG. 5, in which the orifice (24) is out of phase with respect to orifices (21) and (22) and, as a consequence, determines the position of closing of the valve.

Figure 6:
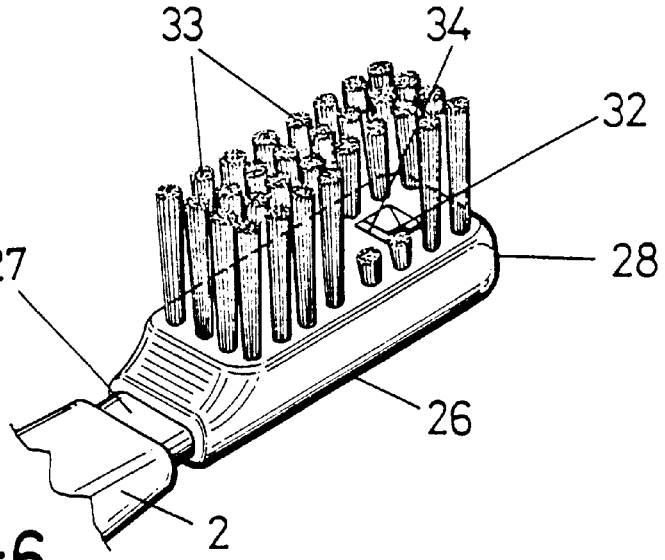
FIG. 6 shows a view in perspective of the head of the toothbrush, embodied in accordance with the object of this invention, with a part of its bristles in cross section to show concretely the exit orifice for the toothpaste, which head is shown coupled to the corresponding handle, which has been represented only partly.
Figure 7:
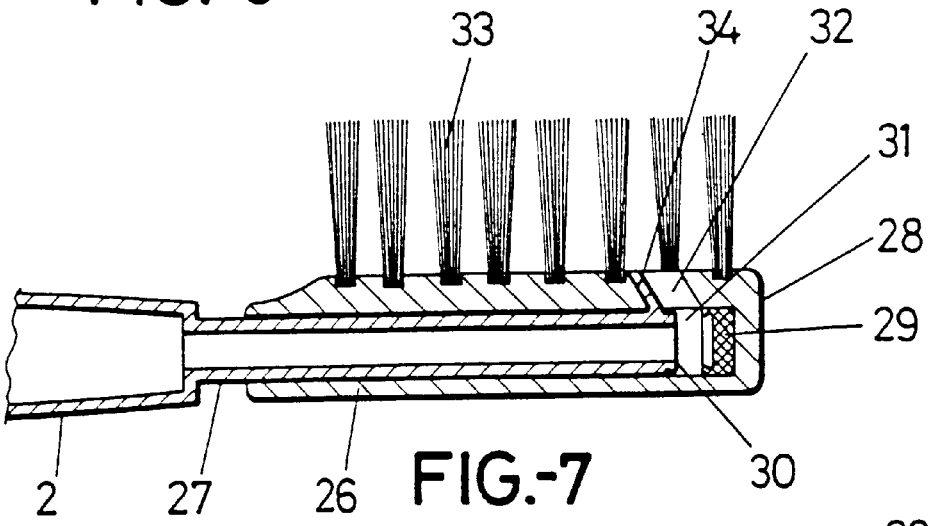
FIG. 7 shows a view in side elevation and in longitudinal section of the assembly in the open position for the exit of the toothpaste to the area of the bristles of the brush.
Figure 8:
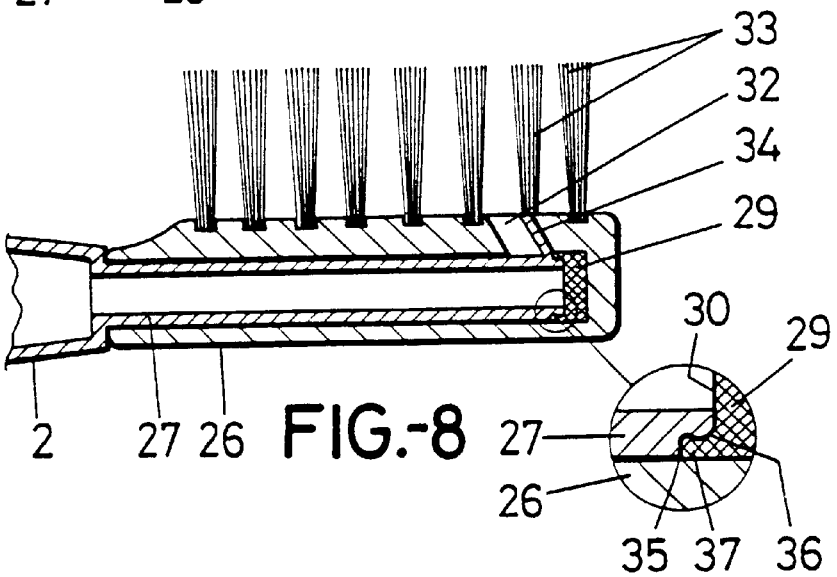
FIG. 8 shows, finally, a view similar to that of FIG. 7 but in which the head is closed; also represented is a magnified detail of the coupling of the sealing joint at the mouth of the tubular core for the exit of the toothpaste, in which can be observed the male-female coupling, between these elements, which determines stability for said seal.

FIGS. 6, 7 and 8 show another alternative with regard to the blocking and exit of the toothpaste, which blocking is provided in the corresponding head (26), which can be coupled in the corresponding end of the forward portion of the body (2) of the handle, for which a provision has been made that, in this end of the body (2), the handle is prolonged in a tubular core (27), on which is installed specifically the head (26), which installation is achieved as a consequence that said head (26) is provided with an axial orifice and a blind portion of the cross section and which coincides dimensionally with the tubular core (27), making it possible to adjust perfectly by sliding between the two parts, making it impossible for the toothpaste to exit through the interface between the two parts or pieces.

At the closed end (28) of the head, a sealing gasket (29) has been provided which, when the head (26) is retracted to the maximum, is coupled to the mouth (30) of the tubular core (27), producing a hermetic seal for it, as shown in FIG. 8, while when such head is separated or moved outward with respect to the tubular core (27), between the above-mentioned mouth (30) and the sealing gasket (29), a small chamber (31) is created, which communicates directly with the outside through an orifice (32), preferably inclined rearward, that is, toward the central area of the head (26) to provide better centering, of the dose of toothpaste inside the bristles (33) which, as is conventional, are a part of said head.

These limit positions of opening and closing of the head are defined by a fin (34) which emerges as a single piece from the free end of the tubular core (27) and which, with the same inclination as the orifice (32), moves on the interior of the latter, as is clearly observed in FIGS. 7 and 8.

Said fin (34) is also used as a cleaning element for the duct, through which the toothpaste passes to the base of the bristles, assisted in this by the inclined form of the duct, which causes a solid and efficient exit of the toothpaste, thereby preventing the drying out of such paste in the duct due to lack of use of the brush.

Finally, and in order to stabilize appropriately the closed position of the heady shown in FIG. 8, the tubular core (27) is equipped on its free end with a small groove (35) around the perimeter and, on this groove, with a curb (36) also around the perimeter, while the sealing gasket (29), basically embodied in a disk seated on the end (28) of the accommodation in the head (26), in turn incorporates a front groove (37), whose form and dimensions are complementary to the free end of the nuclear core (27) and which determines, with respect to the latter, the male-female coupling observed especially in the magnified detail of FIG. 8, which coupling requires manual traction on the head itself, in the direction away from the handle (2), of sufficient magnitude so that this displacement cannot occur accidentally.

I claim:

1. A toothbrush with a system for feeding and blocking toothpaste, which includes a hollow handle forming a container for the toothpaste and a corresponding hollow head carrying a plurality of bristles coupled to an anterior end of the hollow handle wherein the hollow handle is made up of a first body (1) and a second body (2) which can be moved telescopically by means of overlapping coaxial sectors (3) of the first body and the second body, the sector of the first body (1) is located further from the hollow head of the toothbrush and a container (4) for the toothpaste, and is provided internally at its end with an orifice (5), to which an axial duct is coupled, which communicates with the sector of the second body (2), said axial duct being equipped with a rigid sector (7) and an elastically deformable sector (8), designed to absorb axial displacements of the first body (1) with respect to the second body (2), wherein axial displacement of the elastically deformable sector provides a dose of the toothpaste in accordance with the displacement of elastically deformable sector (8).

2. The toothbrush with a system for feeding and blocking toothpaste of claim 1, wherein the rigid sector (7) has an exit duct for the toothpaste from the container (4), said exit duct is one with the second body (2) and is connected to the head of the toothbrush through a transverse member (9), provided with an orifice (11) coaxial with said exit duct in which a blocker (12) of a first one-way valve moves, said blocker tends always to the closed position as a result of a spring (13).

3. The toothbrush with a system for feeding and blocking toothpaste of claim 1 wherein the container (4) is located in the first body (1) and has an interior, said interior is located further from the head of the toothbrush, adjacent an embolus (15), said embolus (15) is assisted by a spring (16) and with which the volume of an operative sector of the container (4) is reduced progressively with consumption of the various doses of the toothpaste.

4. The toothbrush with a system for feeding and blocking toothpaste according to claim 1 wherein the toothbrush includes a second one-way valve (12') located at the rear end of the elastically deformable sector (8) so as to prevent the return of the toothpaste to the container (4) when an embolus (15) is not associated with an element, which prevents its return.

5. The toothbrush with a system for feeding and blocking toothpaste according to claim 1, wherein an exit duct (14), is located beyond a first one-way valve (12), adjacent said exit duct (14) is a manually operated valve consisting of a cylinder (17), which interrupts said exit duct (14), said cylinder is equipped with a diametral orifice (18), said diametral orifice (18) is coupled with said exit duct (14), said cylinder is operated from an outside surface of said cylinder by means of a window (19) in the body (2) and by means of a fin (20), which moves in the interior of said window and is radially solid with the cylinder (17).

6. The toothbrush with a system for feeding and blocking toothpaste of claim 1, wherein the first body (1) and the second body (2) are coupled to internal eccentric ducts (21) and (22), respectively, said internal eccentric ducts rotate relatively between the first body and the second body.

7. The toothbrush with a system for feeding and blocking toothpaste of claim 1, wherein the first body (1) and the second body (2) are equipped with eccentric internal orifices (21) and (22), respectively, aligned coaxially, and between said first and second eccentric internal orifices is placed a disk (23) provided in turn with a third eccentric orifice (24), aligned with the first and second eccentric internal orifices (21) and (22) of the first body (1) and the second body (2), said disk (23) actuated from an outside surface using a tab (25) associated radially thereto and which passes through the second body (2).

8. The toothbrush with a system for feeding and blocking toothpaste of claim 1, wherein a head (26) of the toothbrush is coupled to a tubular extension (27) of the second body (2) of the hollow handle, said extension (27) is a tubular core having a free end, said free end is equipped with an opening (30) for the exit of the toothpaste, the head (26) is moved axially and in the manner of an adjustment on the tubular core (27) between a plurality of limit positions, equipped with an axial orifice and a block, at an end (28) of which there is provided a sealing gasket (29) capable of coupling to the opening (30) of the tubular core (27) or of being moved away from the latter, defining a small chamber (31), from which there emerges an orifice (32), which communicates with the outside, specifically with the area where the bristles (33) are located.

9. The toothbrush with a system for feeding and blocking toothpaste of claim 8, wherein a limiting means for the movement of the head (26) on the tubular and fixed core (27) consists of a fin (34) protruding from the tubular core (27), said fin (34) moves in the actual orifice (32) of exit for the toothpaste, with the end walls of said orifice (32) limiting the displacement of the fin (34) and consequently the relative displacement between the head (26) and the core (27).

10. The toothbrush with a system for feeding and blocking toothpaste of claim 8, wherein an exit orifice (32) and a fin 34 have an inclined position toward the middle zone of the head, which moves in the interior of the head said fin in conjunction with the inclined orifice are an improved means for evacuation of the toothpaste from the output duct, preventing the toothpaste from drying in the duct.

11. The toothbrush with a system for feeding and blocking toothpaste of claims 8, 9 or 10, wherein the tubular core (27) has, at its free end, a small groove (35) in its outside perimeter, on which in turn is placed a rounded curb (36), a sealing gasket (29) is located on the closed end (28) of the head, and has an annular frontal curb (37) designed for male-female coupling at the mouth (30) of the tubular core (27), stabilizing the closing position of the head.

* * * * *